US006019689A

United States Patent [19]

Hogan

[11] Patent Number: 6,019,689

[45] Date of Patent: Feb. 1, 2000

[54] METHOD OF PUTTING

[75] Inventor: Charles Nelson Hogan, Phoenix, Ariz.

[73] Assignee: Holey-Moley L.L.C., Redmond, Oreg.

[21] Appl. No.: 09/078,439

[22] Filed: May 13, 1998

[51] Int. Cl.[7] ..... A63B 53/00

[52] U.S. Cl. ..... 473/409; 473/243

[58] Field of Search ..... 473/405, 407, 473/408, 409, 251–255, 231, 238, 293, 340, 243, 241

[56] References Cited

U.S. PATENT DOCUMENTS

| | | | |
|---|---|---|---|
| 2,919,491 | 1/1960 | Darrell et al. | 473/241 |
| 2,995,375 | 8/1961 | Bukovey | 473/241 |
| 3,220,730 | 11/1965 | Fine | 473/293 |
| 3,486,755 | 12/1969 | Hodge | 473/293 |
| 4,317,568 | 3/1982 | Green | 473/238 |
| 4,824,114 | 4/1989 | Catalano | 473/251 |
| 5,282,622 | 2/1994 | Evans | 473/252 |
| 5,707,299 | 1/1998 | McKenna | 473/241 |

*Primary Examiner*—Steven Wong
*Attorney, Agent, or Firm*—Reidlaw, L.L.C.; John S. Reid

[57] ABSTRACT

A method for putting which achieves improved alignment between the face of the putter and the golf ball towards the desired initial line of progress of the golf ball. In the method, a putter is provided which has a head having a contoured portion of the heel allowing the head to be rotated about the ground from a position where the handle is generally upright to a position where the handle is generally inclined towards the ground. The putter head is provided with an alignment mark allowing a golfer to align the alignment mark, a golf ball, and a golf cup. A golfer positions such a putter such that a golf ball is disposed between the face of the putter and a golf cup. The golfer then rotates the handle of the putter to a position inclined towards the ground such that the face of the putter is facing in a generally upward direction. The golfer then sights along the alignment mark on the body of the putter to align the alignment mark with the golf ball in the direction of the golf cup. The golfer can at this point make further adjustments to the positioning of the head of the putter to account for contours in the ground between the golf ball and the cup. Once the golfer has achieved the desired alignment, the golfer rotates the handle of the putter to a generally upright position such that the face of the putter is essentially perpendicular to the ground. The golfer then grasps the putter, maintaining the achieved alignment, and hits the golf ball with the face of the putter to urge the golf ball in the general direction of the golf cup.

5 Claims, 7 Drawing Sheets

METHOD OF PUTTING

TECHNICAL FIELD

This invention pertains to the field of the game of golf, and in particular to a novel method for putting a golf ball.

BACKGROUND OF THE INVENTION

In the game of golf, one of the more difficult operations is aligning a putt to sink a golf ball into a hole over a relatively short distance. Heretofore, golfers have relied essentially on a sense of direction to align their putts using only their visual perception to determine whether the face of the putter is indeed perpendicular to the desired line of travel between the golf ball and the hole. A perpendicular face positioning is preferable since essentially all putters are fabricated with an essentially flat face. The laws of kinematics dictate that a ball struck with a flat plane which is perpendicular to the ball will cause the ball to travel in a direction directly perpendicular to the plane, absent any other forces. Normally, a golfer must correct for the contour of the terrain between the golf ball and the hole. Such correction is based on the golfer's experience, but can be erroneous if the face of the putter is not aligned as the golfer believes it to be based on their perception. It has been repeatedly tested that more than 90% of golfers misalign the club face from the right-angle view of the club face to the target line. Thus, what is needed is a method to assure proper alignment between the face of the putter and the golf ball and the golf cup or hole to which the ball is to be urged.

SUMMARY OF THE INVENTION

I have invented a new and useful method for improving putting in the game of golf. The first act of the method comprises providing a putter, the putter having a handle and a body, having a face, the body being configured to allow the putter handle to be inclined towards the ground with the face in a generally upward direction, such that the handle may be smoothly pivoted about the head in an arc to an upright position such that the face of the putter is generally perpendicular to the ground. The body of the putter is provided with an alignment mark to allow a golfer to sight along the aligning mark and a golf ball disposed between the putter and a golf cup. The method next includes the act of positioning the putter proximate a golf ball which is on the ground, such that the golf ball is disposed between the putter and a golf cup disposed within the ground. In the next act of the method, the golfer moves the handle of the putter to a position inclined towards the ground such that the handle of the putter is generally aligned in a direction away from the golf cup and the face of the putter is facing in a generally upward direction. The golfer then sights along the alignment mark on the body of the putter to align the alignment mark with the golf ball in the direction of the golf cup. The golfer than pivots the putter handle about the head to a generally upright position such that the face of the putter is essentially perpendicular to the ground and is proximate the golf ball. Finally, the golfer hits the golf ball with the face of the putter to urge the golf ball in the general direction of the golf cup. This methodology permits accuracy of aim through binocular vision sighting straight to intended target thus eliminating inaccuracies explicit in the normal right-angle view of the club face to target line.

BRIEF DESCRIPTION OF THE DRAWINGS

Preferred embodiments of the invention are described below with reference to the following accompanying drawings.

FIG. 4 is a diagram of a golfer rotating the handle of a putter from a generally upright position to a position inclined towards the ground.

FIG. 6 is a plan schematic diagram showing the aligning act of FIG. 5.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

My invention comprises a method for putting a golf ball which results in improved alignment between the face of the putter, the golf ball, and the hole or golf cup in which the ball is to be deposited.

Figure 1:
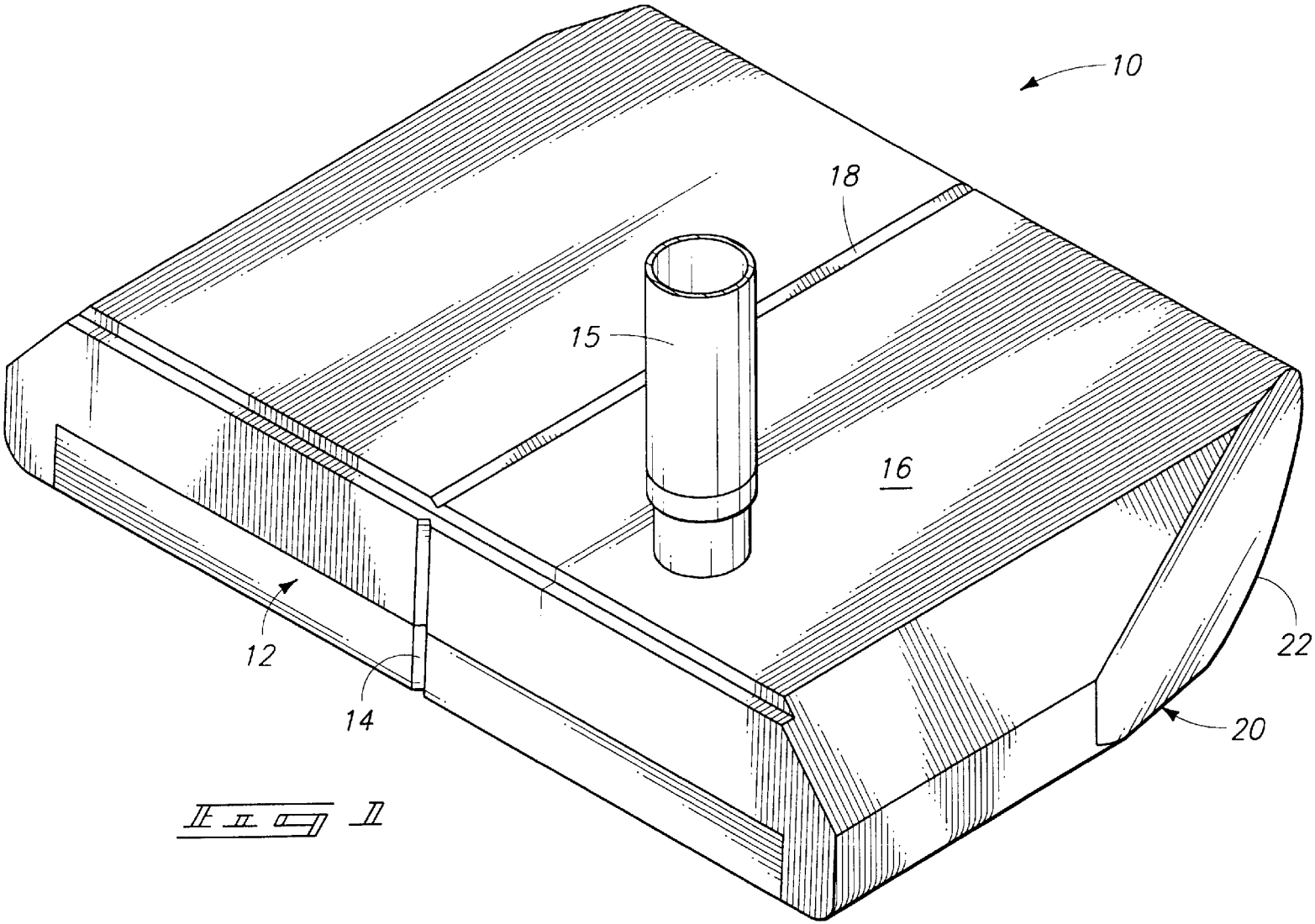
FIG. 1 is an isometric diagram of a head of a putter which may be used in the putting method of the present invention.
Figure 2:
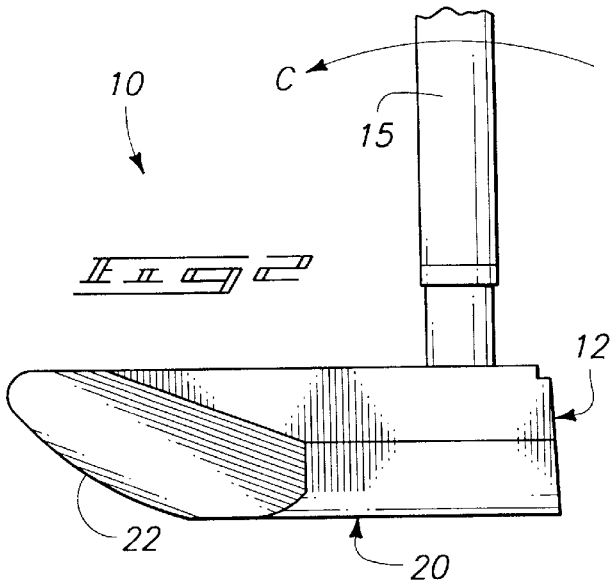
FIG. 2 is a side elevation view of the putter head of FIG. 1.
Figure 3:
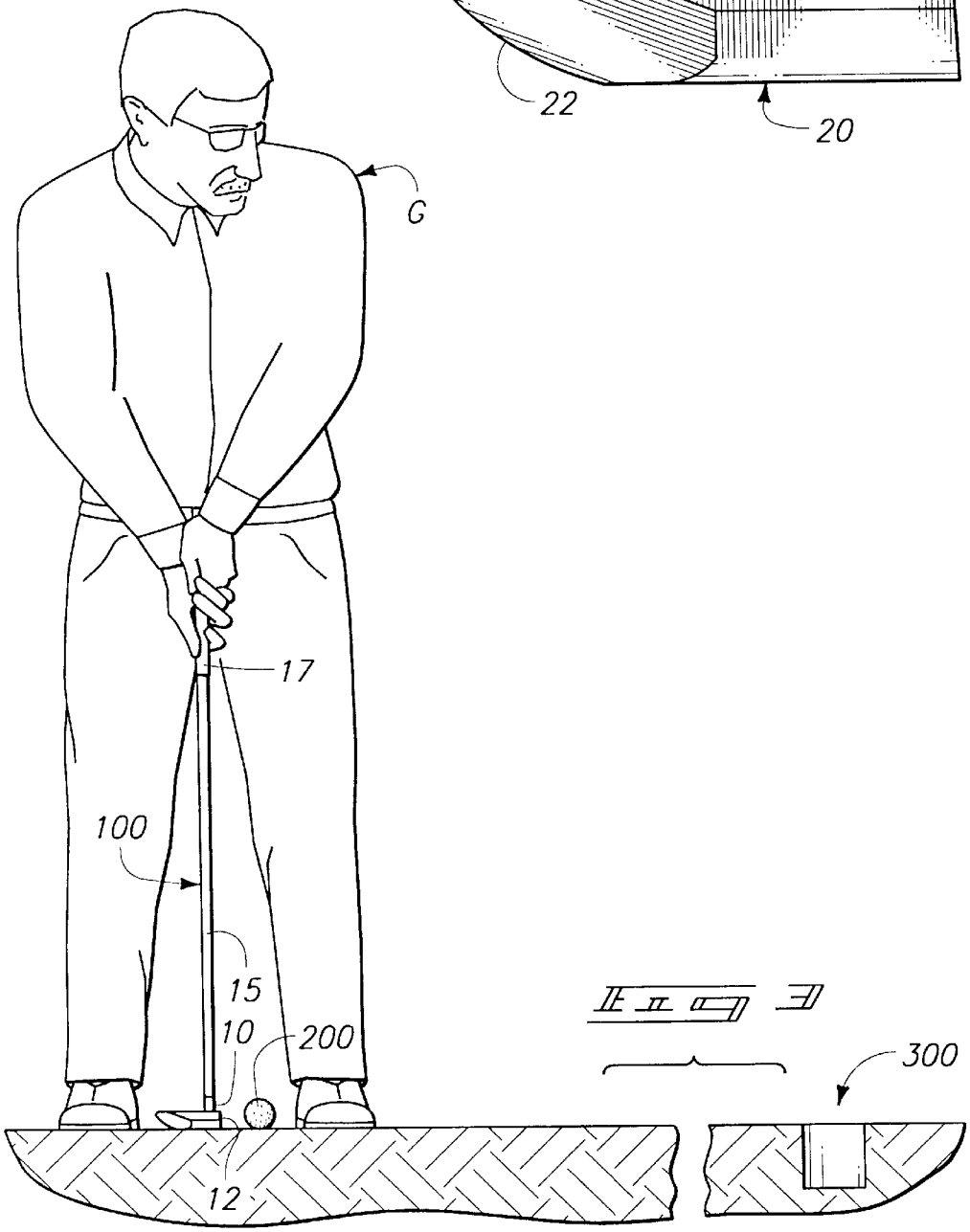
FIG. 3 is a diagram of a golfer positioning a putter proximate to a golf ball in the general direction of a golf hole.
Figure 3:
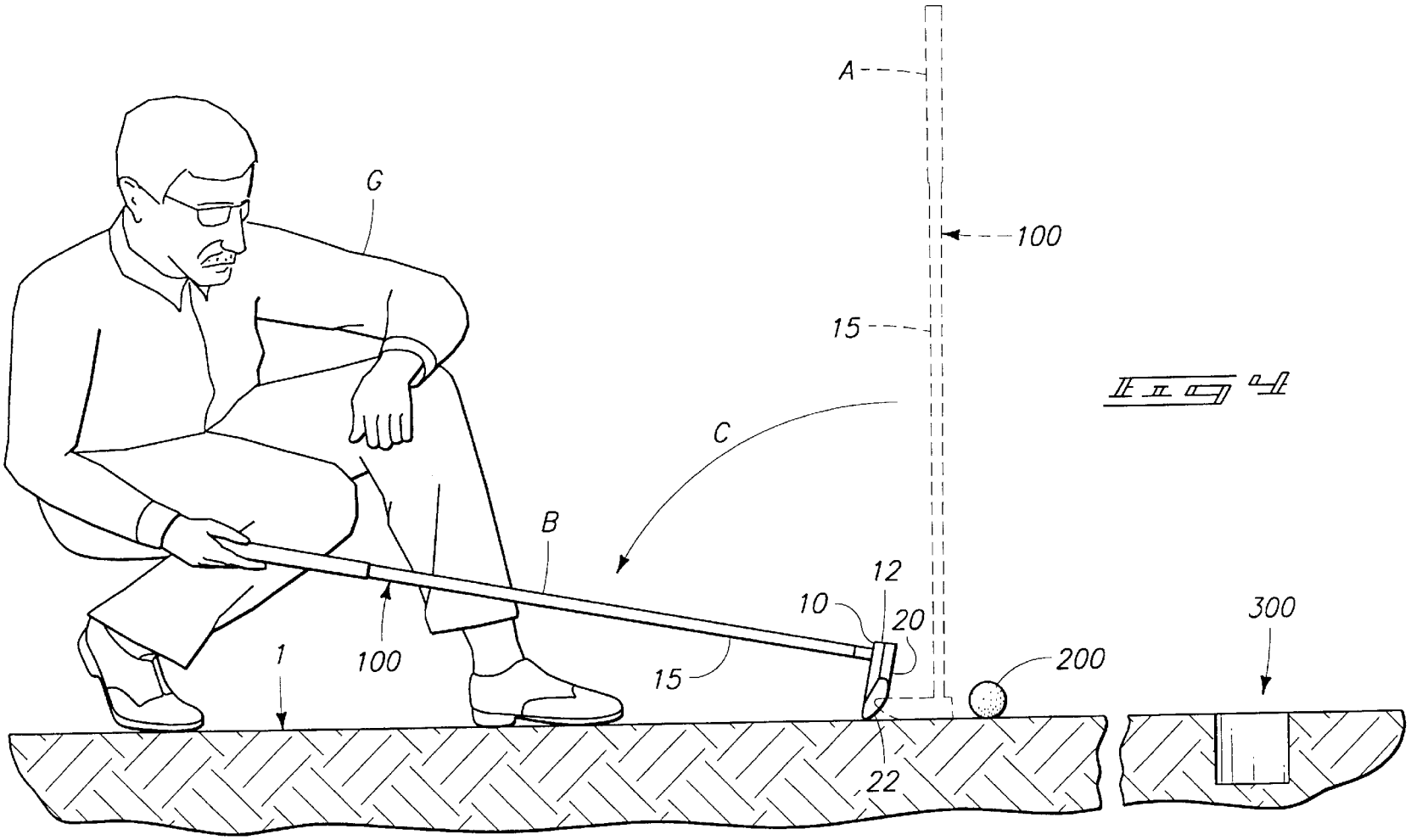

The first act of the method involves providing a putter which is particularly configured to be useful in the method. Turning to FIG. 1, the head of a putter which may be used in the disclosed method is shown. The head 10 of the putter comprises a face 12 having a vertical slot or line 14 disposed thereon. The putter head 10 further comprises an elongated body portion 16 having a line or slot 18 disposed thereon and collinear with line 14 on the face 12 of the putter. The head 10 of the putter further comprises a sole or base 20 which preferably includes a contoured heel portion 22 which allows the head of the putter to be smoothly rotated about the curved portion 22 of the heel 20. The putter further comprises a handle 15 which terminates at the upper end in a grip 17, which is shown in FIG. 3. Preferably, the face 12 of the putter body 10 is a flat face or plane which is essentially perpendicular to the ground when the handle is held in a normal putting position. However, variations on the angle of the face of the putter with respect to the ground can be accommodated by other putters without detracting from the effectiveness of the claimed method. Thusly, the features which make the putter particularly useful for the disclosed method are an alignment mark along the upper part of the body and the face of the putter allowing a golfer to sight along the alignment mark and golf ball towards a golf cup, and a sole having a portion configured to allow the putter to be generally rotated about the ground to allow the handle to be inclined towards the ground. FIG. 2 shows a side elevation view of the head of a putter which may be used in the method of the present invention, showing the sole 20 with the curved heel 22 allowing the putter to be rotated in direction C to incline the handle 15 towards the ground.

Once a putter which may be used in the method is provided, the next act is positioning the putter proximate a golf ball which is on the ground such that the golf ball is disposed between the putter and a golf cup disposed within the ground. Such is shown in FIG. 3 where a golfer G is holding a putter 100 such that the face 12 of the head 10 of the putter is proximate a golf ball 200, and the golf ball is disposed between the putter head 10 and the golf cup 300. This act may be known as "addressing" the golf ball. At this point, the golfer G may generally sight-align the face 12 of the putter head 10 to be approximately perpendicular to a line between the face 12 of the putter, the golf ball 200, and the golf cup 300.

In the next act, which is shown in FIG. 4, the golfer G moves the handle 15 of the putter 100 from the position shown in A in the direction of arrow C to the position shown in B wherein the handle 15 of the club 100 is generally inclined towards the ground 1. In this act, the head 10 of the putter 100 is rotated about the curved portion 22 of the sole 20 of the putter. Following this rotation of the golf club handle, the face 12 of the putter is generally facing in an upward direction as shown in the figure. The rotation of the golf club 100 generally occurs about an axis (which may be a moving axis depending on the geometry of the curve portion 22 of the putter head) which is perpendicular to the plane of the drawing shown in FIG. 4. This axis is also preferably parallel to the face 12 of the putter head 10. This act of the method may generally be known as "rotating the putter handle."

Figure 5:
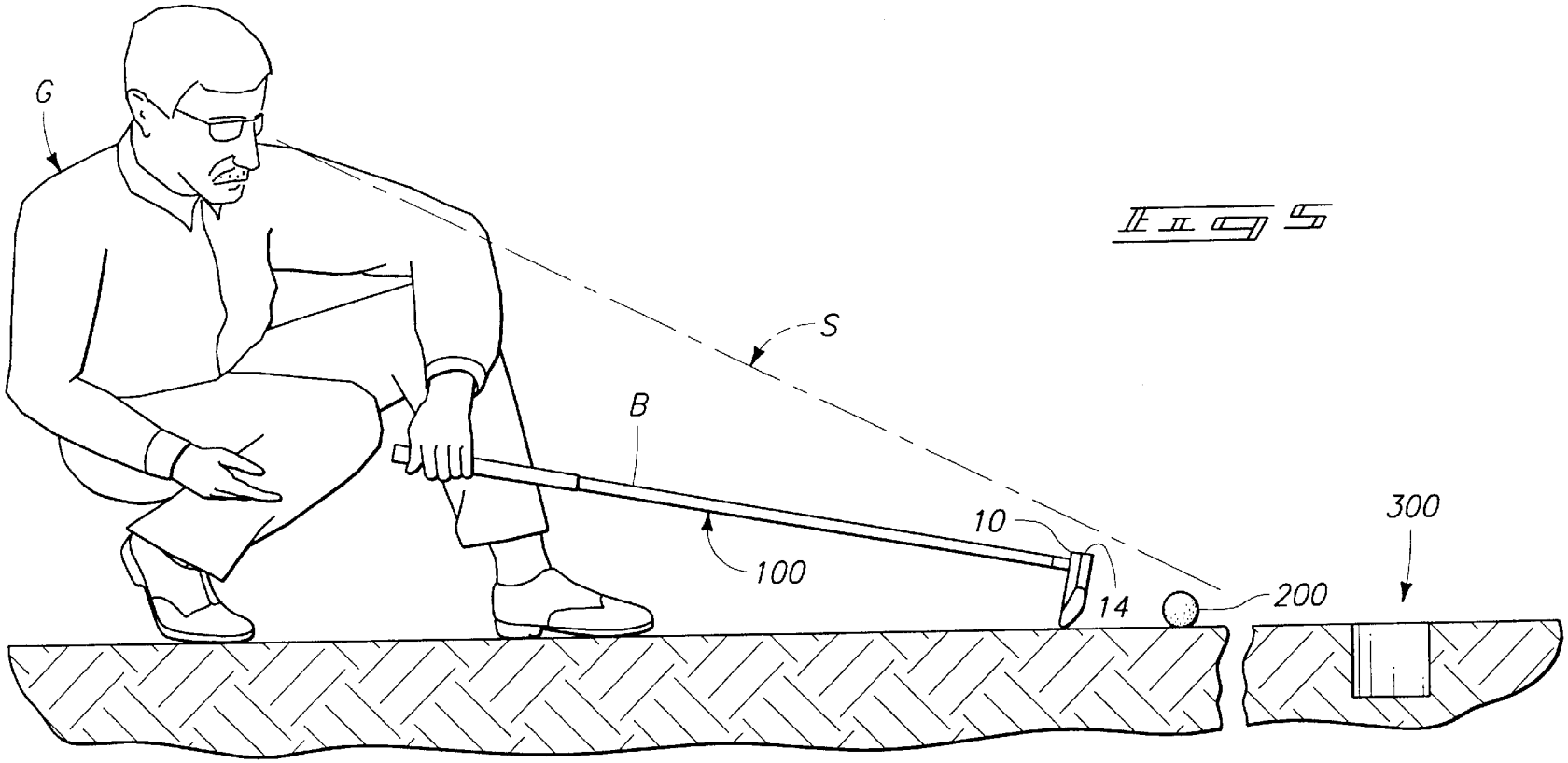
FIG. 5 is a diagram of a golfer aligning an alignment mark on the putter with a golf ball in the general direction of a golf hole.
Figure 5:
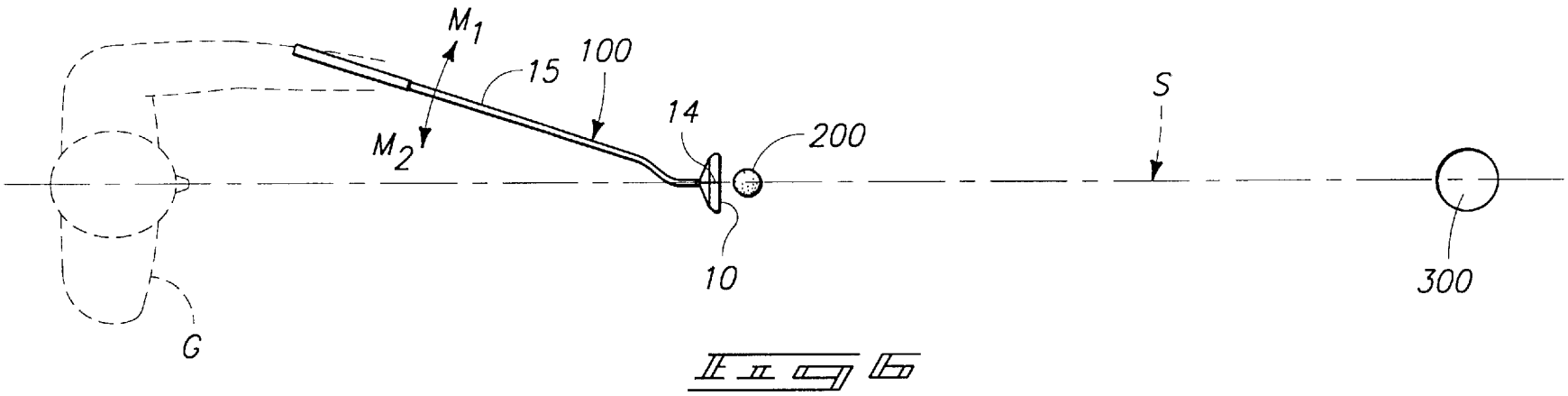

The next act in the method is shown in FIG. 5. In this act, the golfer G sights along the alignment marks 14 and 18 on the face and body of the putter (respectively) 10 to align the alignment marks with the golf ball 200 in the direction of the golf cup 300. The line of sight S is shown in FIG. 5. This act may generally be known as the "alignment" act.

FIG. 6 shows a plan view of the alignment act which is shown in FIG. 5. It can be seen that the line of sight S aligns the point of focus of the golfer G with the center of the golf cup 300 along the alignment line 14 and the centroid of the golf ball 200. If the line of sight S does not align these points then the golfer G can advantageously rotate the handle 15 of the putter 100 in direction $M_1$ or $M_2$ in order to position the alignment mark 14 to achieve alignment of the alignment mark, the golf club 200, and the golf cup 300 with the golfer G's line of sight S.

Figure 7:
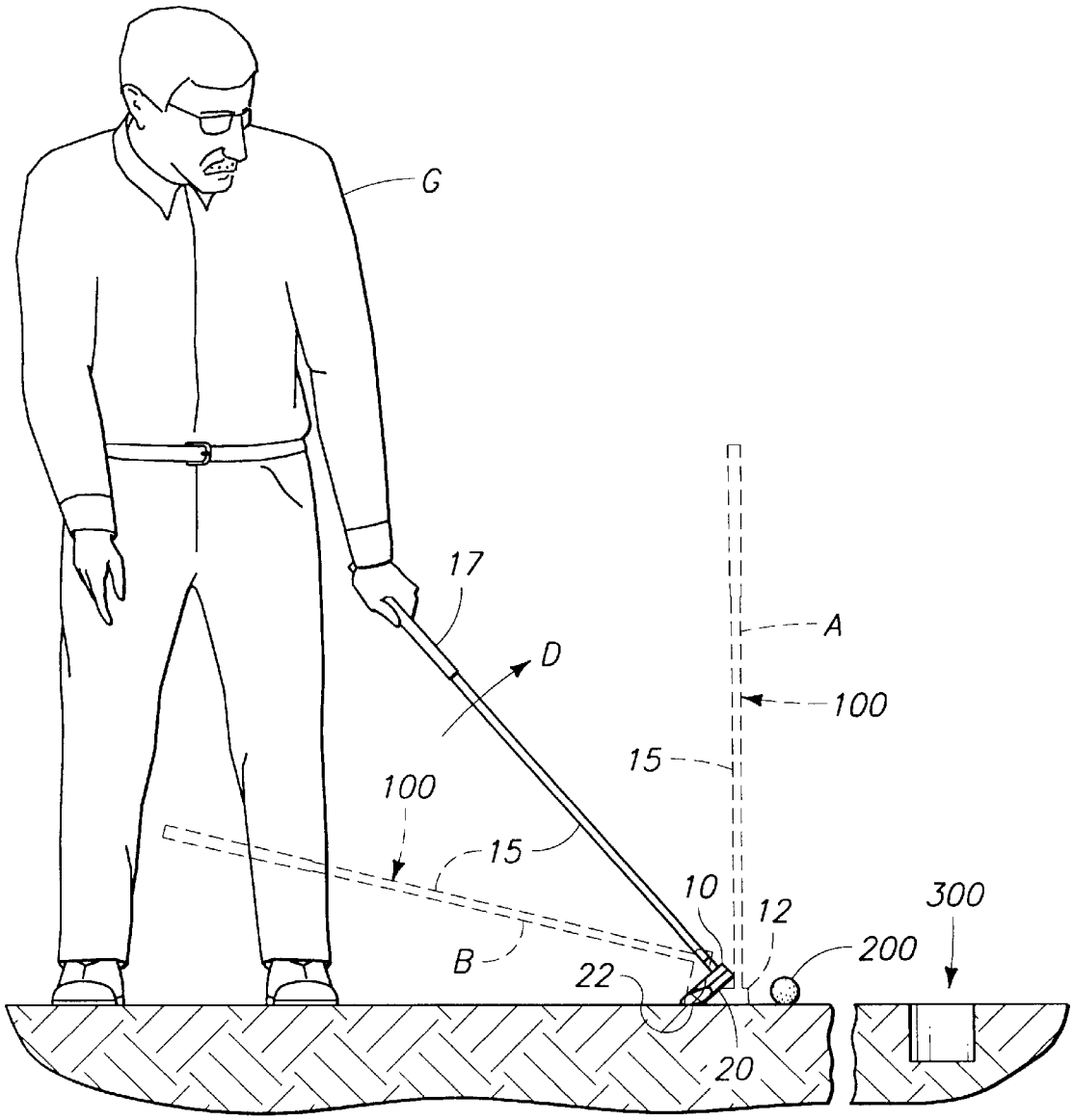
FIG. 7 is a diagram showing a golfer rotating t he handle of a putter from a direction inclined towards the ground to a generally upright direction such that the face of the putter is essentially perpendicular to the ground and proximate the golf ball.

In the next act of the method, which is shown in FIG. 7, the golfer advantageously holds the putter 100 by grip 17 and rotates the putter from the position shown in B about the line of motion D to the generally upright position shown in A. The rotation of the handle 15 is achieved by rotating the sole 20 of the putter head 10 about the curved portion 22. Following the act of rotating the handle to the generally upright position, the face 12 of the putter body 10 should be generally perpendicular to a line connecting the alignment mark 14 (not shown), the centroid of the gold ball 200, and the center of the golf cup 300. Preferably, during this act of rotating the putter into the generally upright position, the alignment achieved in the previous act and shown in FIG. 6 is maintained. This is advantageously assisted by having a curvature 22 of the putter head 10 shown in FIGS. 1 and 2 which allows rotation of the putter head 10 about an axis (which may be a moving axis) which is parallel to the face 12 of the putter. The act shown in FIG. 7 may generally be known as the "rotate up" act.

The next act of the method is for the golfer to move into the position shown in FIG. 3, grasping the grip 17 of the putter 100 so that the golfer G may swing the putter 100 at the ball 200 towards golf cup 300. This act of the method may be known as the "final address" act.

Figure 8B:
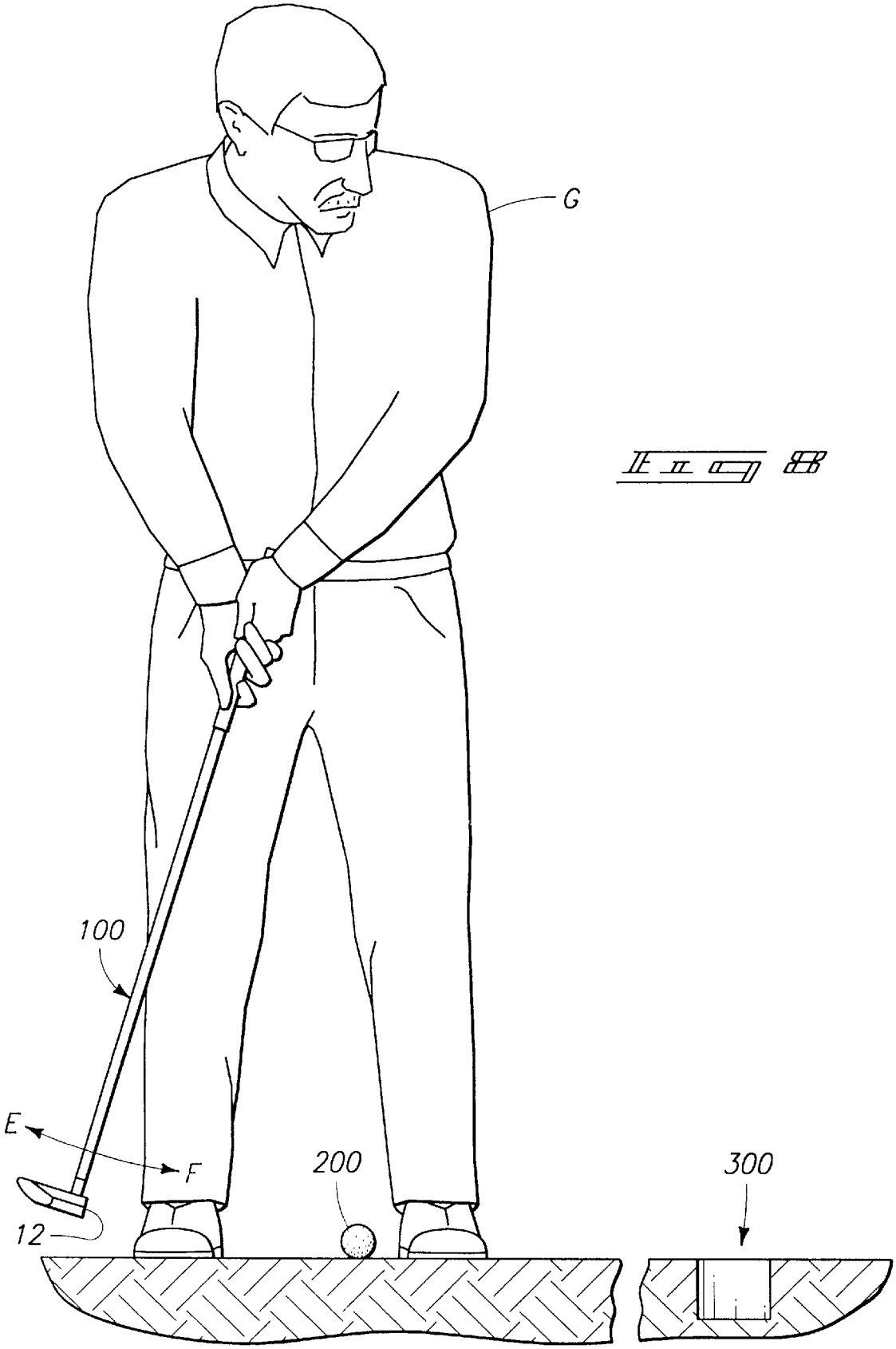
FIG. 8 is a diagram of a golfer swinging a putter at a golf ball to urge the golf ball in the general direction of the golf hole.

In the final act of the method, which is shown in FIG. 8, the golfer G swings the putter 100 in the first direction E and then in the second direction F to allow the face of the putter 12 to strike the golf ball 200, urging golf ball 200 towards the golf cup 300. During this act, which may be known as the "swing" act, the golfer advantageously generally maintains the alignment of the face 12 of the putter from that which was achieved during the alignment act which is shown in FIGS. 5 and 6.

In a further act of the method which may be performed as part of the act of aligning the putter, generally shown in FIGS. 5 and 6, the golfer can correct the alignment for the contour of the ground between the golf ball 200 and the golf cup 300. Such alignment to account for contours in the ground is based on a golfer's experience, judgment, and the laws of physics. For example, if the ground between the golf ball and the golf cup is generally sloping away to the golfer's left (as shown in FIG. 6), the golfer will want to adjust the line of sight-alignment S to a position to the right of the golf cup 300, thus accounting for downhill role of the golf ball 200 as it progresses from its initial position towards the golf cup 300. Other such adjustments are common and well known in the art and will not be discussed further herein. One advantage of the present method is that the alignment of the putter removes error from the general aligning, allowing the golfer to correct for contours in the ground without having to be concerned about general alignment errors due to an inaccurate perception of the perpendicularity of the face of the putter 12 to the desired initial line of progress of the golf ball 200 towards the golf cup 300.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. Method for putting, comprising the sequential acts of:

(a) providing a putter, the putter having handle and a body having a face, the body being configured to allow the putter handle to be inclined towards the ground with the face in a generally upward direction, such that the handle may be smoothly pivoted about the head in an arc to an upright position such that the face is generally perpendicular to the ground, the body being further provided with an alignment mark to allow a golfer to sight along the aligning mark and a golf ball disposed between the putter and a golf cup;

(b) positioning the putter proximate a golf ball which is on the ground, such that the golf ball is disposed between the putter and a golf cup disposed within the ground;

(c) moving the handle of the putter to a position inclined towards the ground such that the handle is generally aligned in a direction away from the golf cup and the face of the putter is facing in a generally upward direction;

(d) sighting along the alignment mark on the body of the putter and adjusting the position of the handle of the putter to align the alignment mark with the golf ball in the direction of the golf cup while the handle of the putter is in the position inclined towards the ground;

(e) pivoting the putter handle about the head to move the handle of the putter from the position inclined towards the ground to a generally upright position such that the face of the putter is essentially perpendicular to the ground and is proximate the golf ball; and (f) hitting the golf ball with the face of the putter to urge the golf ball in the general direction of the golf cup.

2. The method of claim 1 further comprising in act (d) the act of correcting the alignment for the contour of the ground between the golf ball and the golf cup.

3. The method of claim 1 further comprising, between acts (e) and (f), standing adjacent the handle of the putter and gripping the handle of the putter.

4. The method of claim 1 further comprising, in act (e), maintaining minimal rotation of the putter about an axis perpendicular to the ground during the pivoting of the putter handle.

5. The method of claim 1 wherein the putter is further configured such that the putter head generally exhibits minimal rotation about an axis perpendicular to the ground during the pivoting of the handle about the head.

* * * * *